US006745805B2

(12) United States Patent
Thomson

(10) Patent No.: US 6,745,805 B2
(45) Date of Patent: Jun. 8, 2004

(54) DEVICES AND KITS FOR HOLDING MONEY

(75) Inventor: Chip Edward Thomson, Austin, TX (US)

(73) Assignee: beza, L.P., Austin, TX (US)

( * ) Notice: Subject to any disclaimer, the term of this patent is extended or adjusted under 35 U.S.C. 154(b) by 0 days.

(21) Appl. No.: 10/060,942

(22) Filed: Jan. 30, 2002

(65) Prior Publication Data

US 2003/0140996 A1 Jul. 31, 2003

(51) Int. Cl.[7] ..... A45C 1/06; A45C 11/18; B42F 1/02

(52) U.S. Cl. ..... 150/137; 150/138; 150/147; 206/39; 24/67 R; 24/67.5

(58) Field of Search ..... 150/137, 147, 150/131; 206/37, 38; 224/918; 24/67 R, 67.5, 67.7, 67.9, 558

(56) References Cited

U.S. PATENT DOCUMENTS

| | | | | | |
|---|---|---|---|---|---|
| 475,425 | A | * | 5/1892 | Vawter et al. | 24/67 R |
| 1,133,388 | A | * | 3/1915 | Merrill | 24/558 |
| 1,139,627 | A | | 5/1915 | Baltzley | |
| 1,150,073 | A | | 8/1915 | Spengler | |
| 1,435,917 | A | * | 11/1922 | Ensign | 24/558 |
| 2,125,768 | A | * | 8/1938 | Christensen et al. | 40/23 |
| 4,129,237 | A | * | 12/1978 | Grinder | 224/918 X |
| 4,286,358 | A | | 9/1981 | Levin | 24/67 |
| 4,532,680 | A | * | 8/1985 | Hashimoto | 24/67 R |
| D283,844 | S | * | 5/1986 | Saad et al. | D19/65 X |
| 4,675,953 | A | | 6/1987 | Higgs | 24/499 |
| 4,761,862 | A | * | 8/1988 | Hiromori | 24/67.9 |
| D321,210 | S | | 10/1991 | Hiromori | D19/65 |
| 5,080,223 | A | * | 1/1992 | Mitsuyama | 206/39.5 |
| 5,249,336 | A | * | 10/1993 | Miller | 24/67.5 |
| 5,249,437 | A | | 10/1993 | Cole, Jr. | 63/2 |
| D372,498 | S | | 8/1996 | Sato | D19/65 |
| 5,653,276 | A | * | 8/1997 | Niernberger | 150/137 |
| 5,956,881 | A | * | 9/1999 | Dehm | 43/4 |
| D435,340 | S | * | 12/2000 | Kojoori | D3/250 |
| 6,327,749 | B1 | | 12/2001 | Antinone | 24/67 |

FOREIGN PATENT DOCUMENTS

FR 2714807 A1 * 7/1995

* cited by examiner

*Primary Examiner*—Sue A. Weaver
(74) *Attorney, Agent, or Firm*—Fulbright & Jaworski L.L.P.

(57) ABSTRACT

Devices for holding money, whether paper or plastic. One device has a clip portion having inner and outer surfaces, two arms pivotally coupled to the clip portion, an outer covering material attached to at least a portion of the outer surface, and an inner covering material attached to at least a portion of the inner surface. The device can have inserts disposed in openings of the two arms. A kit that includes a device for holding money and a wallet configured to fit within the device, and more specifically to fit within the clip portion of the device, is also disclosed.

9 Claims, 10 Drawing Sheets

DEVICES AND KITS FOR HOLDING MONEY

BACKGROUND OF THE INVENTION

1. Field of the Invention

The present invention relates generally to devices that hold money.

2. Description of Related Art

Devices that hold money, whether in the form of paper currency or credit cards, come in a variety of shapes and sizes. Examples of such devices, sometimes referred to as money clips, are found in U.S. Pat. Nos. 6,327,749, 5,249,437, and 4,675,953. Devices known as binder clips, which are typically used in an office setting for keeping documents together in the absence of a staple, have been used as money clips. This is true of both binder clips without ornamentation of any kind, such as those depicted in U.S. Pat. Nos. 1,150,073 and 1,139,627, and with ornamentation as shown in U.S. Pat. No. 6,327,749. Other binder clips are disclosed in U.S. Pat. Nos. D372,498 and D321,210.

SUMMARY OF THE INVENTION

The present invention includes devices and kits for holding money. The devices can be used to advertise corporate or other types of logos. The kits are equally useful for advertising purposes.

In one embodiment, the invention is a device for holding money. The device includes a clip portion having an inner surface, an outer surface, and two ends; a first arm pivotally coupled to one of the two ends, the first arm having a first arm end that includes a first opening; a second arm pivotally coupled to the other of the two ends, the second arm having a second arm end that includes a second opening; an outer covering material attached to at least a portion of the outer surface; and an inner covering material attached to at least a portion of the inner surface.

In another embodiment, this device also includes a first insert disposed within the first opening; and a second insert disposed within the second opening. The first and second inserts may include magnetically coupled markers. The outer covering material may cover substantially all of the outer surface and the inner covering material may cover substantially all of the inner surface. The outer and inner covering materials may comprise leather. The outer and inner covering materials may comprise non-smooth leather.

In another embodiment, the invention is a device for holding money that includes a clip portion having an inner surface, an outer surface, and two ends; a first arm pivotally coupled to one of the two ends, the first arm having a first arm end that includes a first opening, and a first solid portion; a second arm pivotally coupled to the other of the two ends, the second arm having a second arm end that includes a second opening, and a second solid portion; a first insert disposed within the first opening; and a second insert disposed within the second opening. The first insert may include a magnetically coupled marker, as may the second insert.

In another embodiment, the invention is a kit for holding money. The kit includes a device for holding money. This device includes a clip portion having an inner surface, an outer surface, and two ends; a first arm pivotally coupled to one of the two ends, the first arm having a first arm end that includes a first opening, and a first solid portion; a second arm pivotally coupled to the other of the two ends, the second arm having a second arm end that includes a second opening, and a second solid portion; a first insert disposed within the first opening; and a second insert disposed within the second opening.

In another embodiment, this kit also includes a wallet configured to fit within the clip portion. The wallet includes a first pocket configured to hold one or more credit cards. The wallet may also include a stiffener coupled to the first pocket; and a second pocket coupled to the stiffener, the second pocket being configured to hold one or more credit cards. The first and second pockets may each be configured to securely hold one or more credit cards. The first insert may include a magnetically coupled marker, as may the second insert.

In another embodiment, the device of this kit also includes an outer covering material attached to at least a portion of the outer surface; and an inner covering material attached to at least a portion of the inner surface. The outer covering material may cover substantially all of the outer surface and the inner covering material may cover substantially all of the inner surface. The outer and inner covering materials may comprise leather. The outer and inner covering materials may comprise non-smooth leather.

In other embodiments, the solid portions of any of the embodiments of the invention can include convexly-bowed portions that are aligned with and positioned opposite of each other when the arms of the relevant device are in a closed position.

BRIEF DESCRIPTION OF THE DRAWINGS

The following drawings form part of the present specification and are included to further demonstrate certain aspects of the present devices and kits. The present devices and kits may be better understood by reference to one or more of these drawings in combination with the description of illustrative embodiments presented herein. These drawings illustrate by way of example and not limitation, and they use like references to indicate similar elements. The drawings are not necessarily drawn to scale.

DESCRIPTION OF ILLUSTRATIVE EMBODIMENTS

As a preliminary matter, it should be noted that in this document (including the claims), the terms "comprise" (and any form thereof, such as "comprises" and "comprising"), "have" (and any form thereof, such as "has" and "having"), and "include" (and any form thereof, such as "includes" and "including") are open-ended transitional terms. Thus, a thing (such as a device or a kit) that "comprises," "has," or "includes" one or more elements possesses those one or more elements, but is not limited to possessing only those one or more elements. For example, a device "comprising" a clip portion, a first arm, a second arm, an outer covering material, and an inner covering material is a device that has, but is not limited to only having, the described elements. In other words, the device possesses the five elements, but is not excluded from possessing additional elements or features that are not listed.

Figure 1:
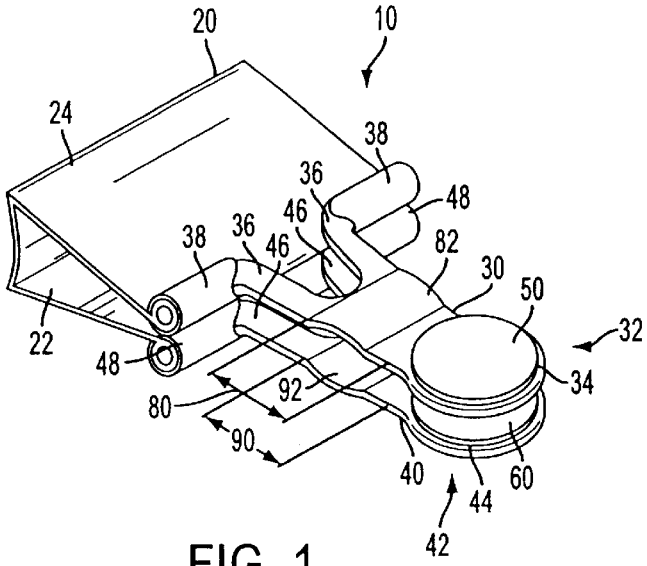
FIG. 1 is a perspective view of one embodiment of the present devices for holding money.

FIG. 1 shows one embodiment of the present invention. FIG. 1 illustrates device 10, which is designed for holding money—whether paper (such as paper currency and the like) or plastic (such as credit cards, bank cards, check cards, automated teller machine (ATM) cards, and the like). Device 10 includes clip portion 20, which has inner surface 22, outer surface 24, and two ends 26. As shown in FIG. 1, device 10 also includes first arm 30 pivotally coupled to one of the two ends 26, and second arm 40 pivotally coupled to the other of the two ends 26. First arm 30 includes two resilient first arm prongs 36, which are disposed within first arm prong receptacles 38 of one of the two ends 26. Second arm 40 includes two resilient second arm prongs 46, which are disposed within second arm prong receptacles 48 of the other of the two ends 26. First arm 30 has first arm end 32 that includes first opening 34. Second arm 40 has second arm end 42 that includes second opening 44. As shown in FIG. 1, first and second inserts 50 and 60 are disposed within first and second openings 34 and 44, respectively. First arm 30 includes first solid portion 80 having first convexly-bowed portion 82. Second arm 40 includes second solid portion 90 having second convexly-bowed portion 92. In another version of the arms (not shown), that can be used with any of the present embodiments, the solid portions do not have convexly-bowed portions.

Figure 4:
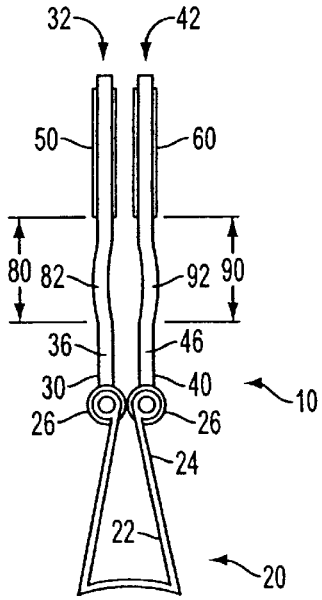
FIG. 4 is a right side view of the device shown in FIG. 1.

As shown in FIG. 4, first convexly-bowed portion 82 is aligned with and positioned opposite of second convexly-bowed portion 92 when first and second arms 30 and 40 of device 10 are a closed position. FIG. 4 is a right side view of device 10. The left side view of device 10 is identical to what is shown in FIG. 4.

Figure 2:
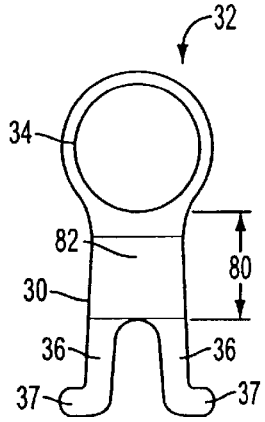
FIG. 2 is a front view of an arm from the device shown in FIG. 1.

FIG. 2 shows a front view of first arm 30. FIG. 2 shows that resilient first arm prongs 36 of first arm 30 include resilient first arm prong projections 37. FIG. 2 also shows first opening 34 without first insert 50. Unlike first arm 30, second arm 40 is not depicted in a separate figure because it includes the same features as first arm 30. Specifically, resilient second arm projections 46 of second arm 40 include resilient second arm prong projections (the only feature of second arm 40 not shown in a figure).

Figure 3:
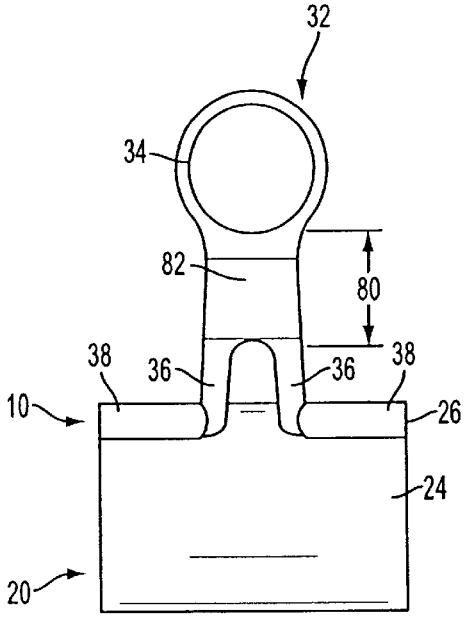
FIG. 3 is a front view of the device shown in FIG. 1.

FIG. 3 shows a front view of device 10. The back, or rear, view of device 10 is identical to what is shown in FIG. 3.

Clip portion 20 and first and second arms 30 and 40 may be made from any suitable material, including metal. Suitable metals include steel, aluminum, gold, silver, platinum, nickel, an alloy including any of these, and the like. In forming the first and second arms of the present devices, the resilient arm prongs of each arm should be made long enough such that it is possible to compress the resilient arm prongs toward each other. After being compressed, the resilient prong arms can be slipped into the resilient prong arm receptacles, and the resiliency of the resilient prong arms should cause them to spring back to their pre-compressed configuration. As a result, the first and second arms will be pivotally coupled to the clip portion.

First and second inserts 50 and 60 may be made from any suitable material, such as metal, ceramic, and the like. One or more logos, words, or emblems may be placed on either or both surfaces of either or both of the first and second inserts. Either or both of the first and second inserts can be formed as solid pieces and then wedged into the first and second openings in the first and second arms. Alternatively, either or both of the first and second inserts can be formed as two pieces (such as two halves) that snap, or otherwise lock, together. The locking can occur before or after disposing the insert in its respective opening.

Figure 5:
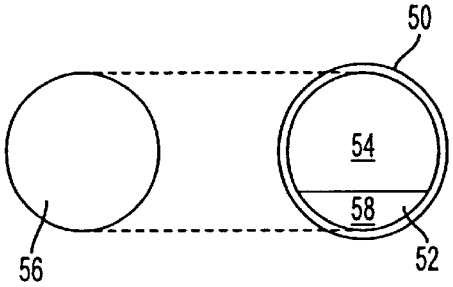
FIG. 5 is a front view of one embodiment of the present inserts.
Figure 6:
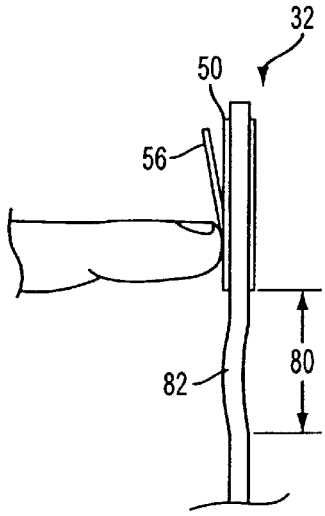
FIG. 6 is a partial right side view of a manner of operating the insert shown in FIG. 5.

In another version of first insert 50, shown in FIGS. 5 and 6, first insert 50 (second insert 60 can be formed in the same way) includes first insert cavity 52. First insert 50 also includes magnet 54, which is attached to first insert cavity 52. As shown in FIG. 5, magnet 54 should not cover the entire face of first insert cavity 52. As a result, gap 58 is formed. In this embodiment, first insert 50 also includes marker 56, which is attachable magnetically to magnet 54. Marker 56 can be used to mark the spot of a golfball on a green. Either or both of the inserts can include such a marker. In this embodiment, marker 56 can be detached from magnet 54 by placing pressure on marker 56 in a way that will force a portion of marker 56 into gap 58. This pressure will also force the portion of marker 56 attached to magnet 54 away from magnet 54, as shown in FIG. 6, making it easy to control marker 56. When force is not applied in this fashion, marker 56 will remain attached to magnet 56 and, as a result, first insert 50 by virtue of the magnetic force generated by magnet 56. Some portion of marker 56 will have to be magnetic for this to work, but the outside of marker 56 can be made of ceramic or any other suitable material. This version of first insert 50 can be applied to any of the embodiments of the present invention. Similarly, the version of second insert 60 utilizing this same type of marker can also be applied to any of the embodiments of the present invention.

Figure 7:
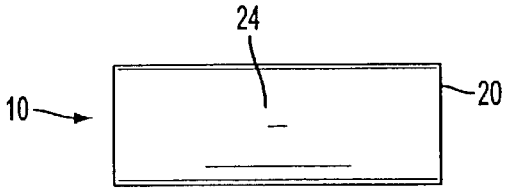
FIG. 7 is a bottom view of the device shown in FIG. 1.
Figure 8:
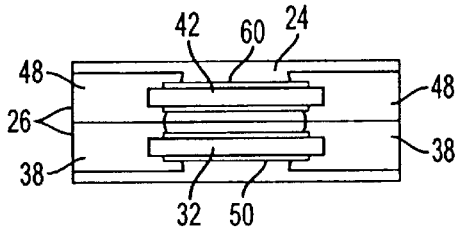
FIG. 8 is a top view of the device shown in FIG. 1.

FIGS. 7 and 8 are bottom and top views, respectively, of device 10.

Figure 9:
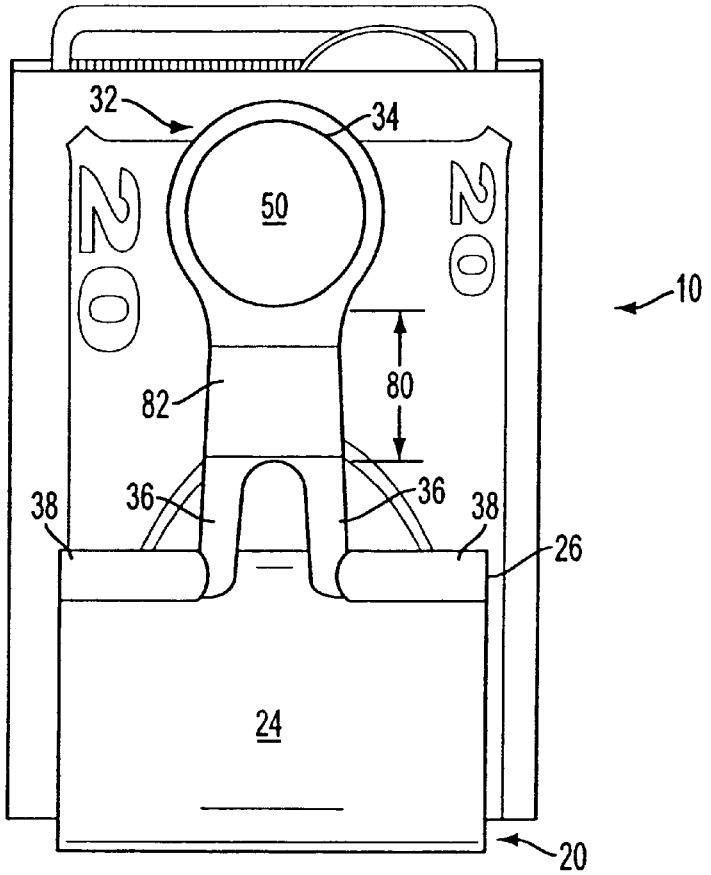
FIG. 9 is a front view of the device shown in FIG. 1 in which the device is holding both paper and plastic currency in a closed position.
Figure 10:
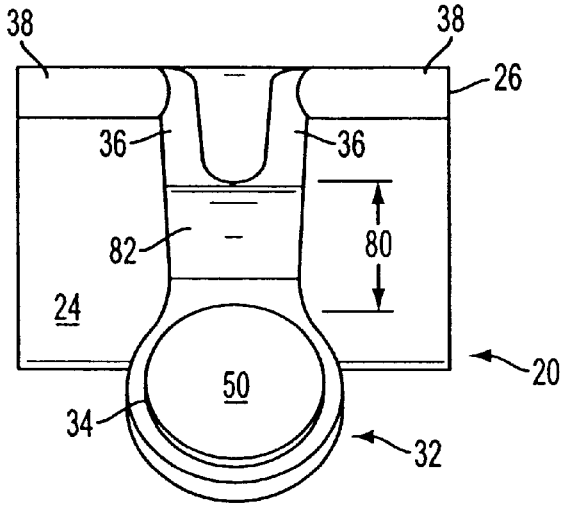
FIG. 10 is a front view of the device shown in FIG. 1 in which the arms of the device are in an open position.

FIG. 9 shows device 10 holding both paper currency and credit cards. First arm 30 and second arm 40 (not visible) are in a closed position. This is typically the position that the device will be carried in by a user. FIG. 10 shows device 10 with first arm 30 and second arm 40 (not visible) in an open position. A user can insert money into clip portion 20 of device 10 by folding back first and second arms 30 and 40 to an open position and applying pressure to the inner surfaces of the arms (such as to the inner surfaces of first and second inserts 50 and 60) sufficient to create enough space for the paper and/or plastic currency to be held by device 10. First and second arms 30 and 40 can then be returned to a closed position to make the device easier to carry. Money can be released in the same way.

Figure 11:
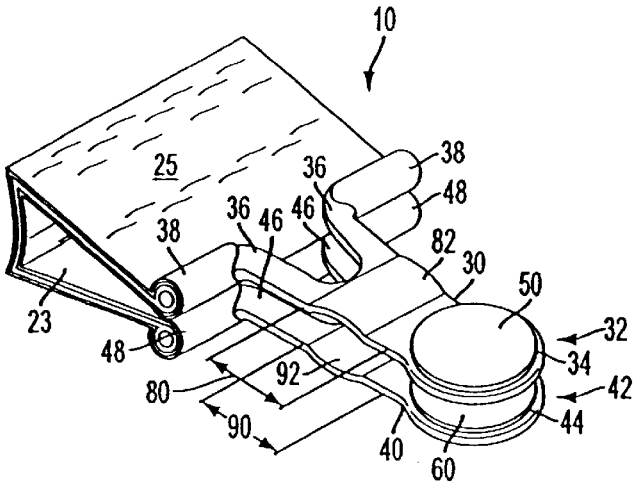
FIG. 11 is a perspective view of another embodiment of the present devices for holding money.

Device 10 in FIG. 11 is another embodiment of the present invention. FIG. 11 shows an outer covering material 25 attached to at least a portion of the outer surface of clip portion 20 of device 10. FIG. 11 also shows an inner covering material 23 attached to at least a portion of the inner surface of clip portion 20. (Element numbers 24 and 22 are omitted for simplicity). These covering materials add to the attractiveness of the present devices, and may be formed of any suitable material. For example, either or both of outer covering material 25 and inner covering material 23 may be formed from leather, whether non-smooth (as shown by the multiple wavy lines shown on outer covering material 25) or smooth. Suitable leathers include cowhide, sharkskin, lambskin, and the like. The covering materials can be attached to the outer and inner surfaces of clip portion 20 using any suitable means, including glue, pressure-sensitive or temperature-sensitive adhesive, and the like. Outer covering material 25 can be the same color as inner covering material 23, or the two can have different colors.

Figure 12:
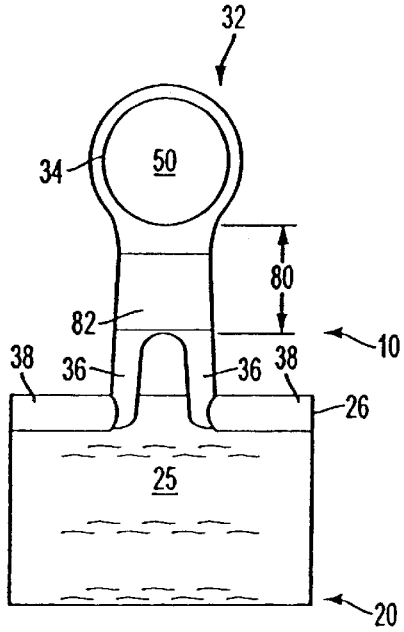
FIG. 12 is a front view of the device shown in FIG. 11.

FIG. 12 shows a front view of device 10 having outer covering material 25 and inner covering material 23 (not visible). The back, or rear, view of this version of device 10 is identical to what is shown in FIG. 12.

Figure 13:
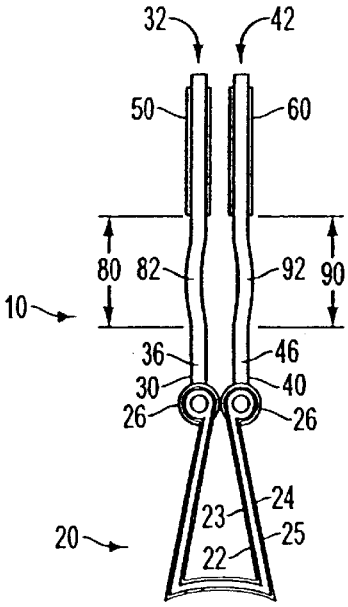
FIG. 13 is a right side view of the device shown in FIG. 11.

FIG. 13 is a right side view of device 10 having outer covering material 25 and inner covering material 23. The left side view of this version of device 10 is identical to what is shown in FIG. 13.

Figure 14:
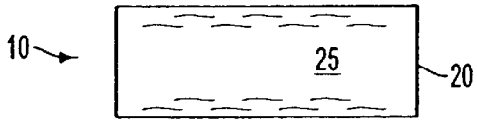
FIG. 14 is a bottom view of the device shown in FIG. 11.
Figure 15:
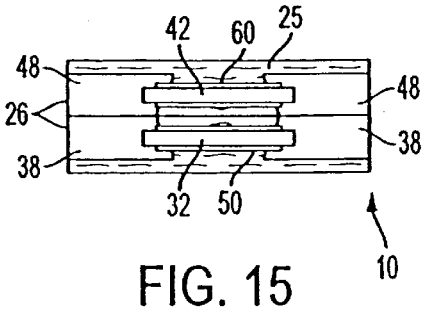
FIG. 15 is a top view of the device shown in FIG. 11.

FIGS. 14 and 15 are bottom and top views, respectively, of device 10 having outer covering material 25 and inner covering material 23.

Figure 16:
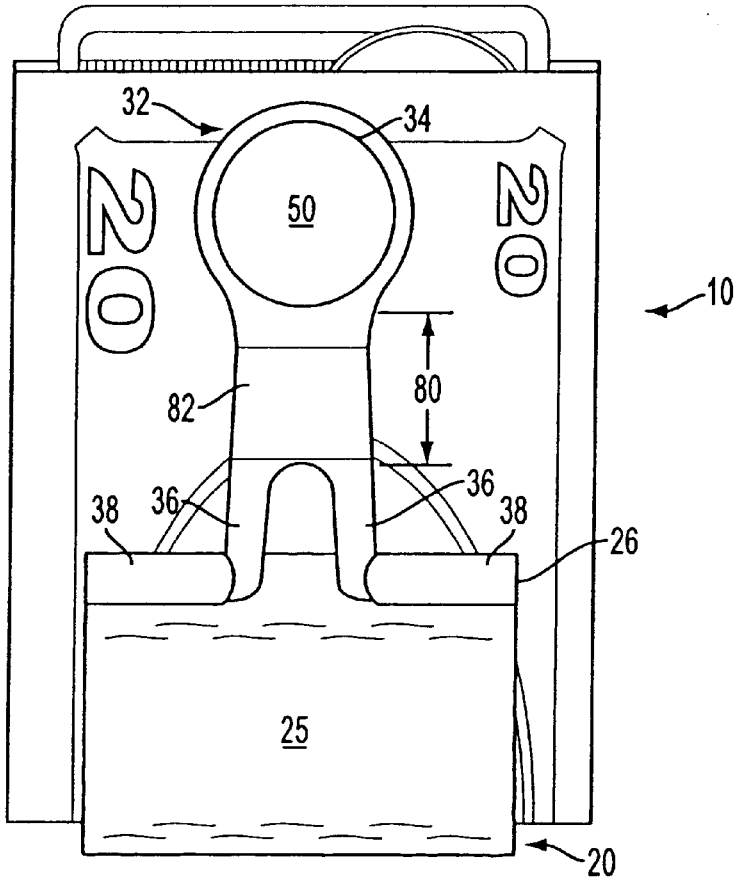
FIG. 16 is a front view of the device shown in FIG. 11 in which the device is holding both paper and plastic currency in a closed position.
Figure 17:
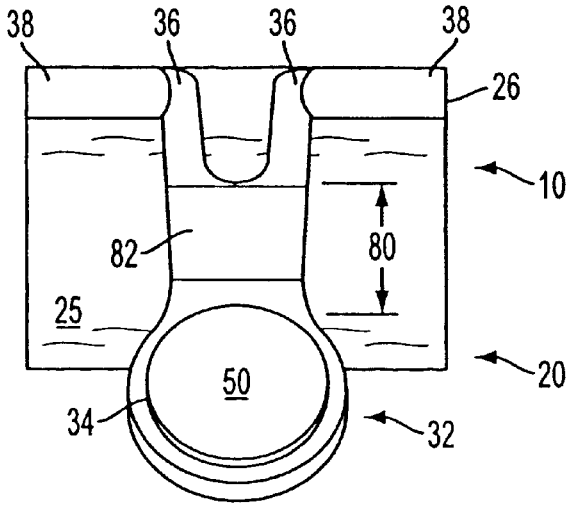
FIG. 17 is a front view of the device shown in FIG. 11 in which the arms of the device are in an open position.

FIG. 16 shows the embodiment of device 10 from FIG. 11 holding both paper currency and credit cards. First arm 30 and second arm 40 (not visible) are in a closed position. FIG. 17 shows the same device 10 with first arm 30 and second arm 40 (not visible) in an open position. Since the only difference between the version of device 10 shown in FIGS. 16–17 and FIGS. 9–10 is the presence of outer and inner covering materials 25 and 23, respectively, the manner of operation of the device in FIGS. 16–17 is the same as the manner of operation described above.

Figure 18:
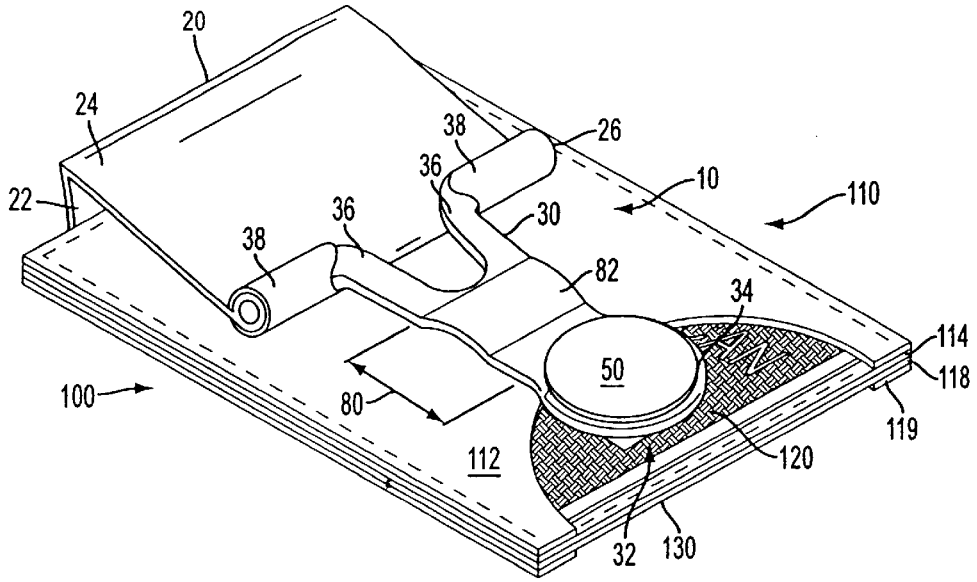
FIG. 18 is a perspective view of one embodiment of the present kits for holding money.

In another embodiment of the present invention, the present devices may be a part of a kit for holding money. FIG. 18 shows kit 100 for holding money, which includes device 10. Device 10 includes the features discussed above with respect to FIGS. 1–4 and will not be repeated here. Kit 100 also includes wallet 110, which is configured to fit within clip portion 20 of device 10. Wallet 110 serves to hold one or more pieces of plastic currency, such as credit cards. Specifically, wallet 110 includes first pocket 120 (shown with a credit card in it). In one version, wallet 110 includes only first pocket 120. In another version, wallet 110 includes second pocket 130 (not visible). One or both pockets can be configured to hold one or more credit cards (or other plastic currency). More specifically, one or both pockets can be configured to securely hold one or more credit cards, meaning that credit cards placed in a given pocket will be unlikely to come out of the pocket without someone pulling them out.

Figure 19:
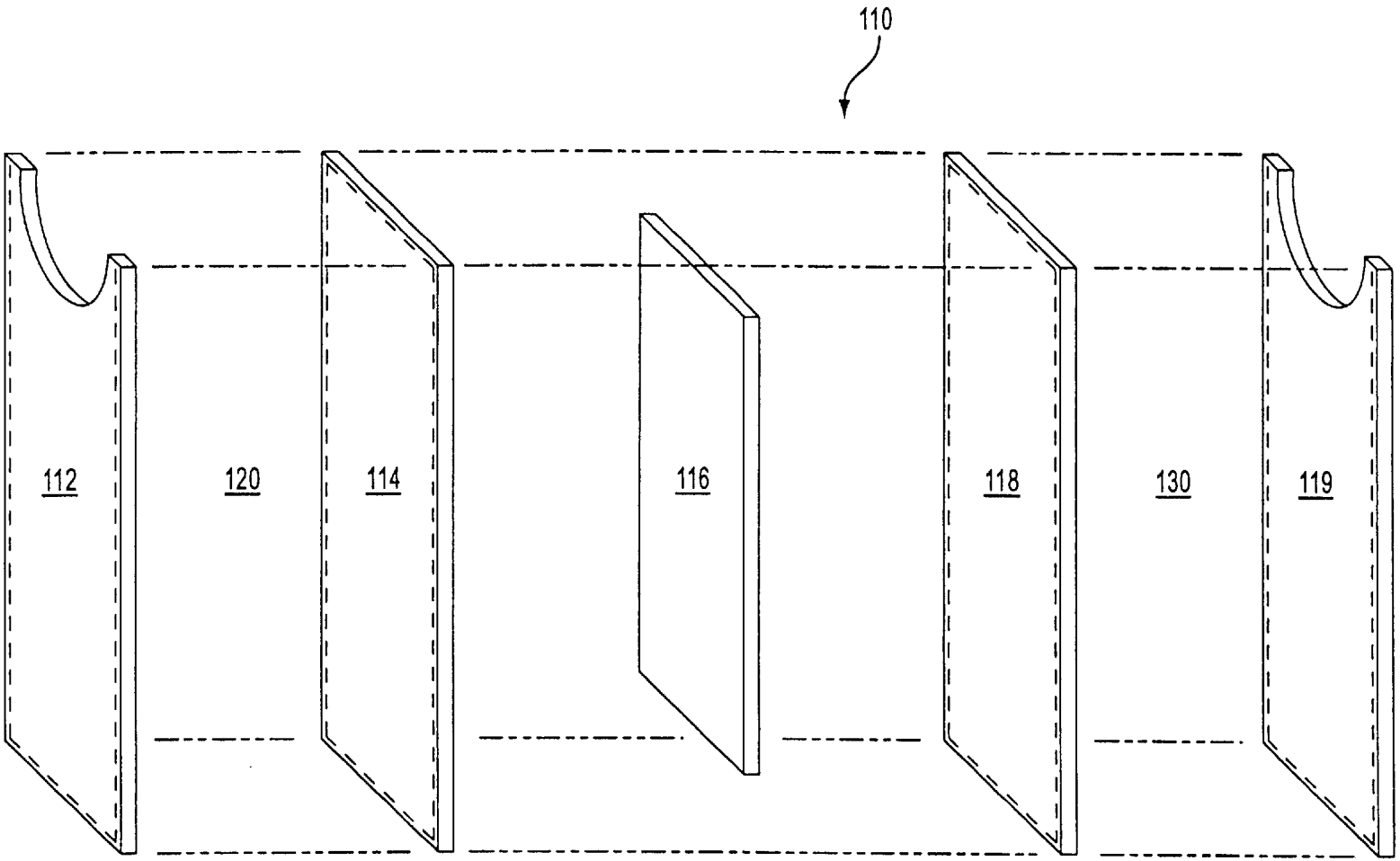
FIG. 19 is an exploded view showing one embodiment of the present wallets.

FIG. 19 shows one embodiment of wallet 110 suitable for use with the present kits. Wallet 110 shown in FIG. 19 is formed from five different portions—outer first pocket piece 112, inner first pocket piece 114, stiffener 116, inner second pocket piece 118, and outer second pocket piece 119. Outer first pocket piece 112, inner first pocket piece 114, inner second pocket piece 118, and outer second pocket piece 119 may be formed from any suitable material, including leather, imitation leather, and the like. Stiffener 116 may be formed of the same material as the four pieces, or of a different material suitable for giving wallet 110 some rigidity, such as plastic, metal, or the like. The four pieces may be sewn together when 110 is made. Together, outer first pocket piece 112 and inner first pocket piece 114 form first pocket 120. Similarly, outer second pocket piece 119 and inner second pocket piece 118 together form second pocket 130.

Figure 20:
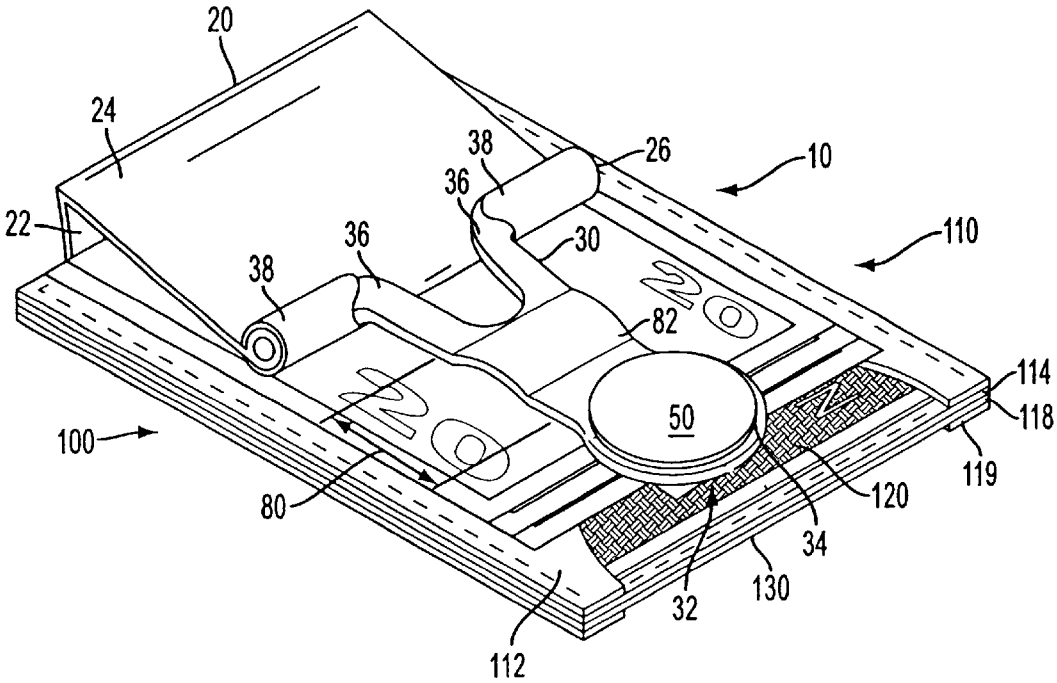
FIG. 20 is a perspective view of the kit shown in FIG. 19 where both paper currency and a wallet are being held by the device.

Kit 100 is useful for people who prefer to keep their plastic currency separate from their paper currency. Using kit 100, a person can place his or her credit cards in wallet 110, fold his or her paper currency around wallet 110, and place clip portion 20 of device 10 around both the paper currency and wallet 110. Such a use of kit 100 is depicted in FIG. 20.

Figure 21:
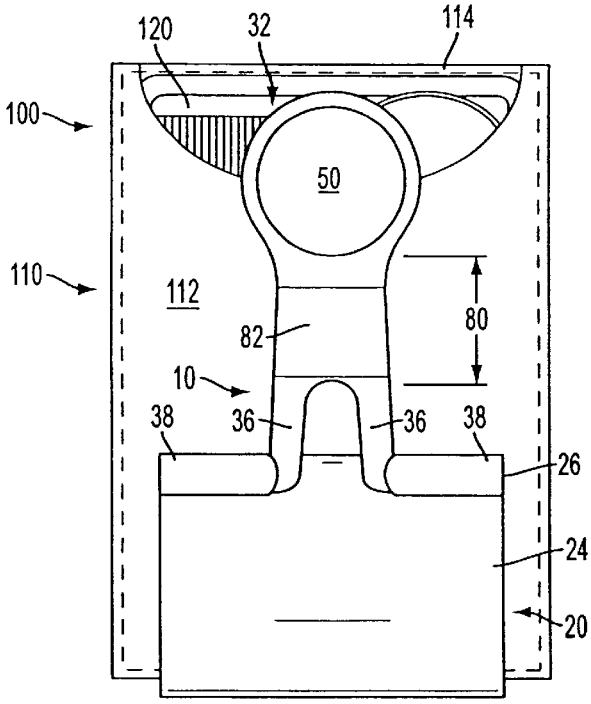
FIG. 21 is a front view of the kit shown in FIG. 18.

FIG. 21 shows a front view of kit 100 in which first pocket 120 of wallet 110 is holding a credit card. The back, or rear, view of kit 100 is identical to what is shown in FIG. 21.

Figure 22:
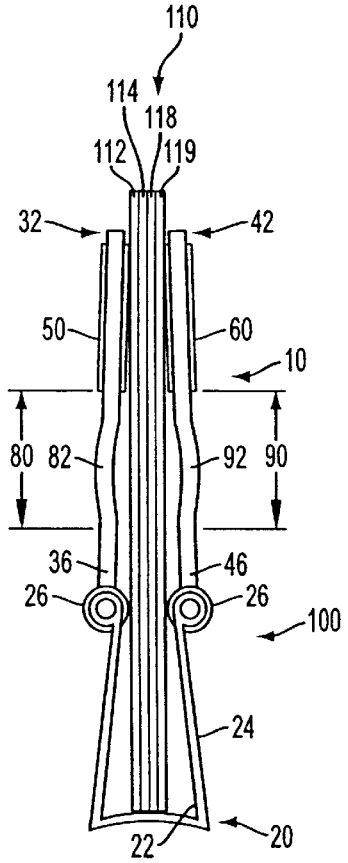
FIG. 22 is a right side view of the kit shown in FIG. 18.

FIG. 22 is a right side view of kit 100. The left side view of kit 100 is identical to what is shown in FIG. 22.

Figure 23:
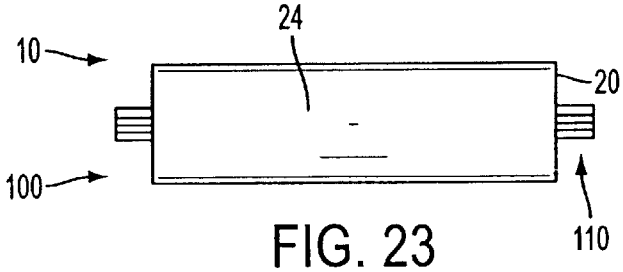
FIG. 23 is a bottom view of the kit shown in FIG. 18.
Figure 24:
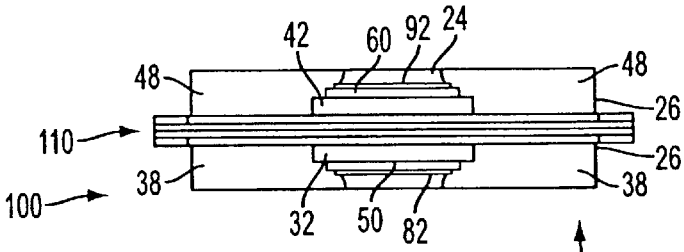
FIG. 24 is a top view of the kit shown in FIG. 18.

FIGS. 23 and 24 are bottom and top views, respectively, of kit 100 having device 10 without any covering materials and with wallet 110 held by clip portion 20 of device 10.

Figure 25:
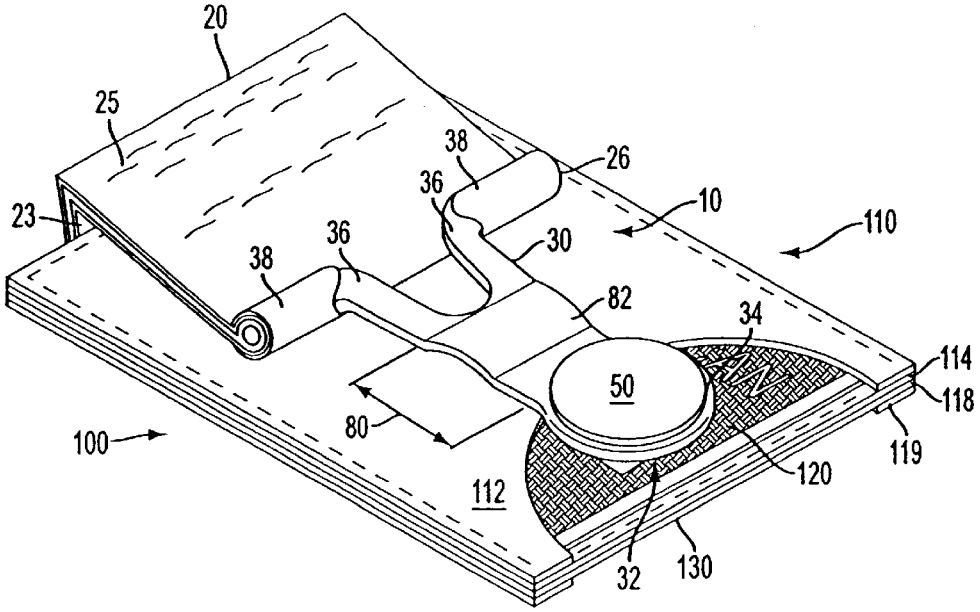
FIG. 25 is a perspective view of another embodiment of the present kits for holding money.
Figure 26:
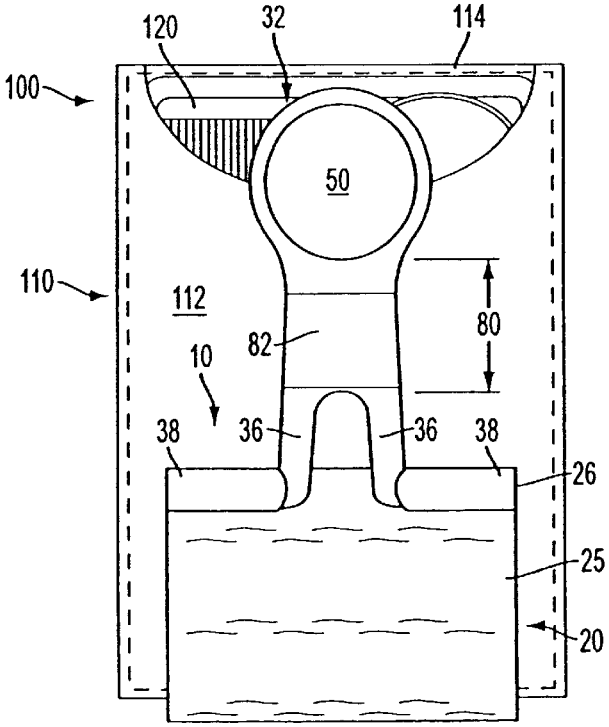
FIG. 26 is a front view of the kit shown in FIG. 25.
Figure 27:
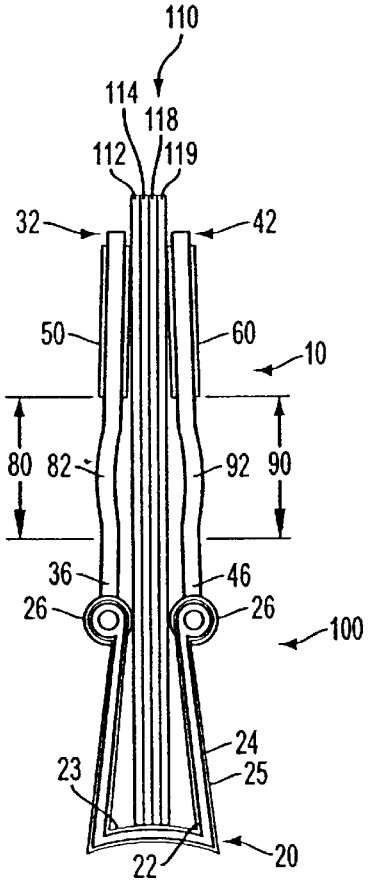
FIG. 27 is a right side view of the kit shown in FIG. 25.
Figure 28:
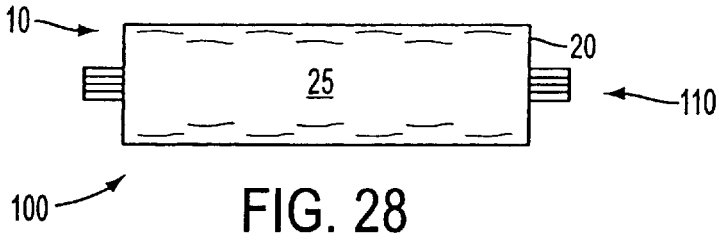
FIG. 28 is a bottom view of the kit shown in FIG. 25.
Figure 29:
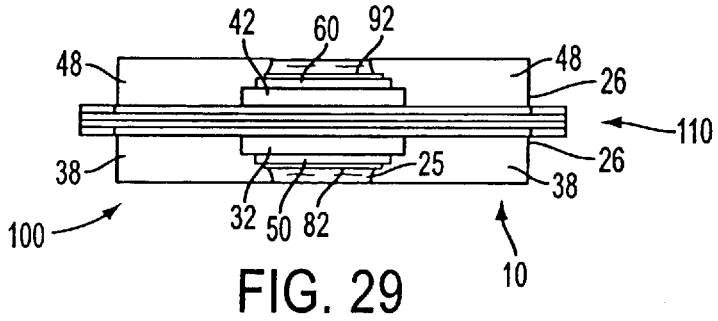
FIG. 29 is a top view of the kit shown in FIG. 25.
Figure 30:
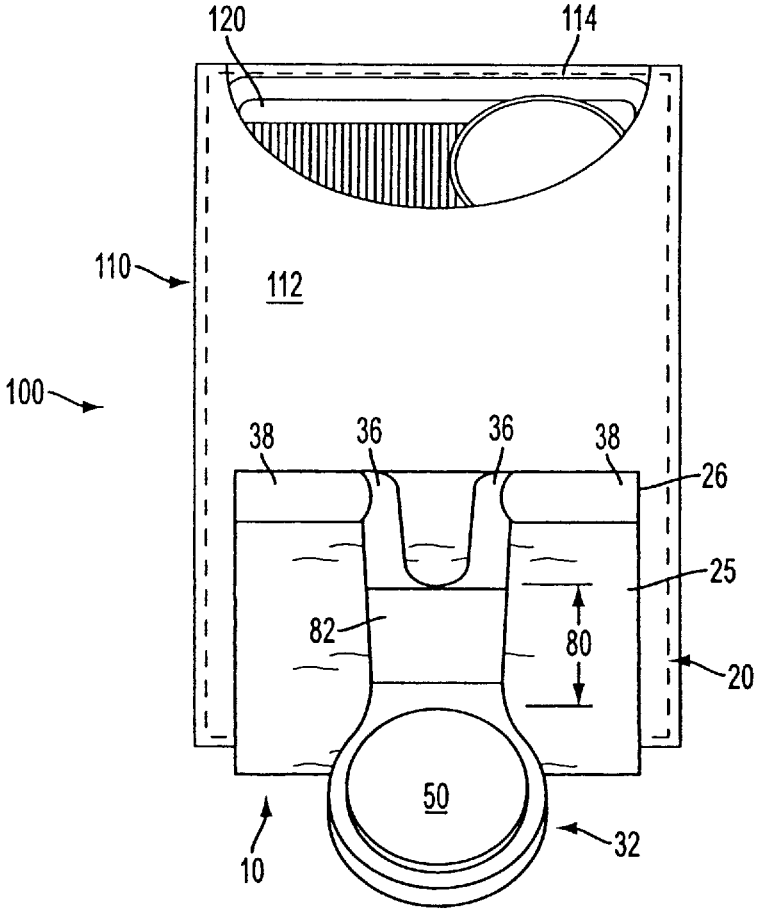
FIG. 30 is a front view of the kit shown in FIG. 25 in which the arms of the device are in an open position.

In another embodiment of the present invention, shown in FIG. 25, device 10 of kit 100 includes outer and inner covering materials 25 and 23, respectively, as described above with respect to FIGS. 11–15. Thus, the only difference between this version of kit 100 and the version of kit 100 depicted in FIGS. 18 and 20–24 is the addition of outer covering material 25 and inner covering material 23 to device 10. As a result, a detailed explanation of the features of this version of kit 100 is not necessary. A version of wallet 110 suited for use with the version of kit 100 depicted in FIG. 25 is the version of wallet 110 depicted in FIG. 19. FIG. 26 depicts front view of the version of kit 100 shown in FIG. 25. The back, or rear, view of this version of kit 100 is identical to what is shown in FIG. 26. FIG. 27 is a right side view of the version of kit 100 shown in FIG. 25. The left side view of this version of kit 100 is identical to what is shown in FIG. 27. FIGS. 28 and 29 are bottom and top views, respectively, of the version of kit 100 shown in FIG. 25. FIG. 30 depicts the version of kit 100 shown in FIG. 25, where first arm 30 and second arm 40 (not visible) are in an open position.

All of the devices and kits for holding money disclosed and claimed can be made and used without undue experimentation in light of the present disclosure. While the devices and kits of this invention have been described in terms of certain embodiments, it will be apparent to those of skill in the art that variations may be applied to these devices and/or kits for holding money without departing from the scope of the present invention as defined by the following claims. For example, the openings in the arms of the present devices may be any suitable shape, including round, oval, square, rectangular, triangular, and the like. Additionally, inserts disposed in the openings can be shaped in the same fashion.

Alternatively, one or both of the arms of the present devices may include a solid portion that runs from the tops of the arm prongs (i.e., just above the arch joining the arm prongs) to the end of the arm. In such an embodiment, the arm does not have an opening. A piece of material suited for use as one of the present inserts may then be attached to the arm near the end of the arm to provide a surface on which a logo or other indicia could then be placed.

I claim:

1. A device for holding money comprising:

(a) a clip portion having an inner surface, an outer surface, and two ends;

(b) a first arm pivotally coupled to one of the two ends, the first arm having a first arm end that includes a first opening;

(c) a second arm pivotally coupled to the other of the two ends, the second arm having a second arm end that includes a second opening;

(d) an outer covering material attached to at least a portion of the outer surface;

(e) an inner covering material attached to at least a portion of the inner surface;

(f) a first insert disposed within the first opening; and (g) a second insert disposed within the second opening, where the first insert includes a magnetically coupled marker.

2. The device of claim 1, where the first insert includes a first magnetically coupled marker, and the second insert includes a second magnetically coupled marker.

3. A device for holding money comprising:

(a) a clip portion having an inner surface, an outer surface, and two ends;

(b) a first arm pivotally coupled to one of the two ends, the first arm having a first arm end that includes a first opening, and a first solid portion;

(c) a second arm pivotally coupled to the other of the two ends, the second arm having:

(i) a second arm end that includes a second opening, (ii) a second solid portion;

(d) a first insert disposed within the first opening; and (e) a second insert disposed within the second opening where the first insert includes a magnetically coupled marker.

4. The device of claim 3, where the first insert includes a first magnetically coupled marker, and the second insert includes a second magnetically coupled marker.

5. A kit for holding money comprising:

(a) a device for holding money comprising:

(i) a clip portion having an inner surface, an outer surface, and two ends;

(ii) a first arm pivotally coupled to one of the two ends, the first arm having a first solid portion and a first arm end that includes a first opening;

(iii) a second arm pivotally coupled to the other of the two ends, the second arm having a second solid portion and a second arm end that includes a second opening;

(iv) a first insert disposed within the first opening;

(v) a second insert disposed within the second opening; and (b) a wallet configured to fit within the clip portion, the wallet comprising:

(i) a first pocket configured to hold one or more credit cards.

6. The kit of claim 5, where the wallet further comprises:

(ii) a stiffener coupled to the first pocket; and (iii) a second pocket coupled to the stiffener, the second pocket being configured to hold one or more credit cards.

7. The kit of claim 6, where the first and second pockets are each configured to securely hold one or more credit cards.

8. The kit of claim 5, where the first insert includes a magnetically coupled marker.

9. The kit of claim 5, where the first insert includes a first magnetically coupled marker, and the second insert includes a second magnetically coupled marker.

* * * * *